US008075396B2

(12) United States Patent
Roemer

(10) Patent No.: US 8,075,396 B2
(45) Date of Patent: Dec. 13, 2011

(54) BONUS GAME AND GAME BONUSING SYSTEM

(75) Inventor: Mickey Roemer, Las Vegas, NV (US)

(73) Assignee: Roemer Gaming, LLC, Las Vegas, NV (US)

( * ) Notice: Subject to any disclaimer, the term of this patent is extended or adjusted under 35 U.S.C. 154(b) by 384 days.

(21) Appl. No.: 12/215,110

(22) Filed: Jun. 24, 2008

(65) Prior Publication Data

US 2008/0268946 A1 Oct. 30, 2008

Related U.S. Application Data

(63) Continuation-in-part of application No. 11/096,575, filed on Mar. 31, 2005, now Pat. No. 7,713,118, which is a continuation-in-part of application No. 10/948,372, filed on Sep. 22, 2004, now abandoned, which is a continuation of application No. 10/899,669, filed on Jul. 26, 2004, now Pat. No. 7,347,775.

(51) Int. Cl.
*A63F 9/24* (2006.01)

(52) U.S. Cl. ..... 463/29; 463/42

(58) Field of Classification Search ..... 463/15–16, 463/25, 35–36, 40–42
See application file for complete search history.

(56) References Cited

U.S. PATENT DOCUMENTS 4,573,681 A 3/1986 Okada
4,657,256 A 4/1987 Okada
4,665,502 A 5/1987 Kreisner
5,050,881 A 9/1991 Nagao
5,074,559 A 12/1991 Okada
5,102,134 A 4/1992 Smyth
5,280,909 A * 1/1994 Tracy ..... 463/27
5,380,008 A 1/1995 Mathis et al.
5,720,662 A 2/1998 Holmes et al.
5,988,638 A 11/1999 Rodesch et al.
6,012,982 A * 1/2000 Piechowiak et al. ..... 463/16
6,068,552 A 5/2000 Walker et al.
6,077,162 A * 6/2000 Weiss ..... 463/26
6,110,043 A * 8/2000 Olsen ..... 463/27
6,155,925 A 12/2000 Giobbi et al.
6,231,445 B1 * 5/2001 Acres ..... 463/42
6,270,412 B1 8/2001 Crawford et al.
2003/0157979 A1 * 8/2003 Cannon et al. ..... 463/16
2004/0102238 A1 5/2004 Taylor
2007/0060330 A1 * 3/2007 Martin ..... 463/29
2008/0070694 A1 * 3/2008 Schlottmann et al. ..... 463/42
2008/0076527 A1 * 3/2008 Low et al. ..... 463/25
2008/0113779 A1 * 5/2008 Cregan ..... 463/27
2008/0254893 A1 * 10/2008 Patel et al. ..... 463/42
2009/0275411 A1 * 11/2009 Kisenwether et al. ..... 463/42
2010/0130280 A1 * 5/2010 Arezina et al. ..... 463/20
2010/0317424 A1 * 12/2010 Hornik et al. ..... 463/20

* cited by examiner

*Primary Examiner* — Masud Ahmed
(74) *Attorney, Agent, or Firm* — Weide & Miller, Ltd.

(57) ABSTRACT

A gaming system is configured to present a bonus event at one or more gaming machines. The gaming machines may be configured to present base wagering games. A bonus server may monitor play at the gaming machines and trigger a bonus event. The bonus event server may be configured to dynamically modify the bonus event trigger based upon the number of gaming machines in play to keep the odds of triggering the bonus event relatively constant. The bonus event may comprise a timed bonus event, such as a tournament in which players of active gaming machines have the opportunity to play one or more free games.

15 Claims, 5 Drawing Sheets

BONUS GAME AND GAME BONUSING SYSTEM

RELATED APPLICATION DATA

This application is a continuation-in-part of 11/096,575, filed Mar. 31, 2005 now U.S. Pat. No. 7,713,118, which is a continuation-in-part of U.S. application Ser. No. 10/948,372 filed Sep. 22, 2004, now abandoned which is a continuation of U.S. application Ser. No. 10/899,669 filed Jul. 26, 2004 now U.S. Pat. No. 7,347,775.

FIELD OF THE INVENTION

The present invention relates to gaming machines and methods of playing games.

BACKGROUND OF THE INVENTION

Gaming continues to grow in popularity and is spreading geographically and demographically. As gaming grows, so does the player's desire for new and exciting games.

A variety of games have been developed recently which include new features designed to add excitement to the game play. These games and gaming machines suffer from a number of drawbacks.

First, a number of games presently offer "bonus" events. These events, however, are generally very static events which are not very exciting. For example, in the play of some slot-type games, if the player receives a certain combination of symbols, a circular wheel printed with bonus values may spin and stop, yielding the player with a bonus pay. These types of bonus events have become common-place, and do not include any player participation.

Second, most machine-presented casino games suffer from the problem that they are single player games. Thus, some players like to play games such as poker and bingo where multiple players are involved. Otherwise, when playing a gaming machine, the game play experience is very isolated.

The present invention is a gaming machine, system and method of game play which has numerous advantages over the prior art games and gaming devices.

SUMMARY OF THE INVENTION

The invention comprises methods of playing/presenting one or more games, gaming machines for presenting games, and gaming systems including gaming machines. Preferably, the games are played as wager type games, with the opportunity for monetary awards for winning results.

One embodiment of the invention is a method of presenting and playing a game including a timed bonus event. In accordance with the invention, a player of a base game may be provided the opportunity to play a bonus event, such as one or more bonus games, for a time period. For example, if a player receives a particular outcome while playing a base game, such as a particular combination of symbols playing a slot game, then the player may be provided the opportunity to play a bonus event for a period of time. In one embodiment, the bonus event may comprise a plurality of individual games, each providing the opportunity for a winning or losing outcome. A player plays as many bonus games as possible during the bonus time period, and is preferably rewarded winnings for the winning outcomes of the bonus games played during the timed bonus event.

In another embodiment, the timed gaming event may comprise a period of time during which enhanced payouts for winning game outcomes are awarded. For example, during a period of time having a start and an end, a player of a gaming machine may be provided the opportunity to be paid a multiplier, such as 2× or 3×, of the payout for each winning outcome received for games played at the gaming machine during the timed event.

Another embodiment of the invention is a timed tournament event. Preferably, players of a plurality of gaming machines play multiple games during a defined period of time. The outcomes of each player's games during the period of time are aggregated to define that player's tournament result. Preferably, the tournament outcome is determined from each player's tournament result. For example, the winner of the tournament may be deemed to be the player having the highest aggregate winnings for all games played during the tournament.

The timed gaming events may comprise base games, bonus games or portions of games or aggregations of games. The timed gaming events may require players to place wagers or may allow players to play for free or for no additional wager. The timed gaming events may involve a single player and/or gaming machine, or multiple players and multiple gaming machines.

One embodiment of the invention is a gaming system including a plurality of gaming machines. The gaming machines are configured to present base games. A bonus event server is configured to trigger a bonus event, such as at all active gaming machines. The bonus event may be triggered in response to activity at the gaming machines, such as particular outcomes or based upon a number of games played, on a random basis, or based upon the size of a player's wager (an extra coin/credit wager) or other factors.

Each of the gaming machines and the bonus server may include their own controller, including a random number generator. In the case of the bonus server, the random number generator may be dynamic, preferably such that the total field of probabilities changes or is adjusted based upon the number of games/machines/players qualified for the bonus event. In one embodiment, the bonus server is configured to trigger a bonus event on average every Nth game played at a gaming machine. In the event multiple gaming machines are active, then the bonus server may be configured to present a bonus game on average every M*N games, where M is the number of active machines. In this manner, bonus events are triggered with the same average frequency regardless of the number of gaming machines in play.

In one embodiment, bonus event wins may yield monetary awards or points. In the case of points, the points might be used for free game play or for prizes.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention comprises gaming machines configured to present a game, one or more games or events, and one or more systems including one or more gaming machines. One or more aspects of the invention comprise gaming bonus events, including timed bonus events and tournament type bonus events.

One embodiment of the invention is a method of presenting and/or playing a game. Preferably, the game is presented on or by a gaming machine. One embodiment of the invention is a gaming machine which is particularly configured to present the game(s) of the invention.

Figure 1:
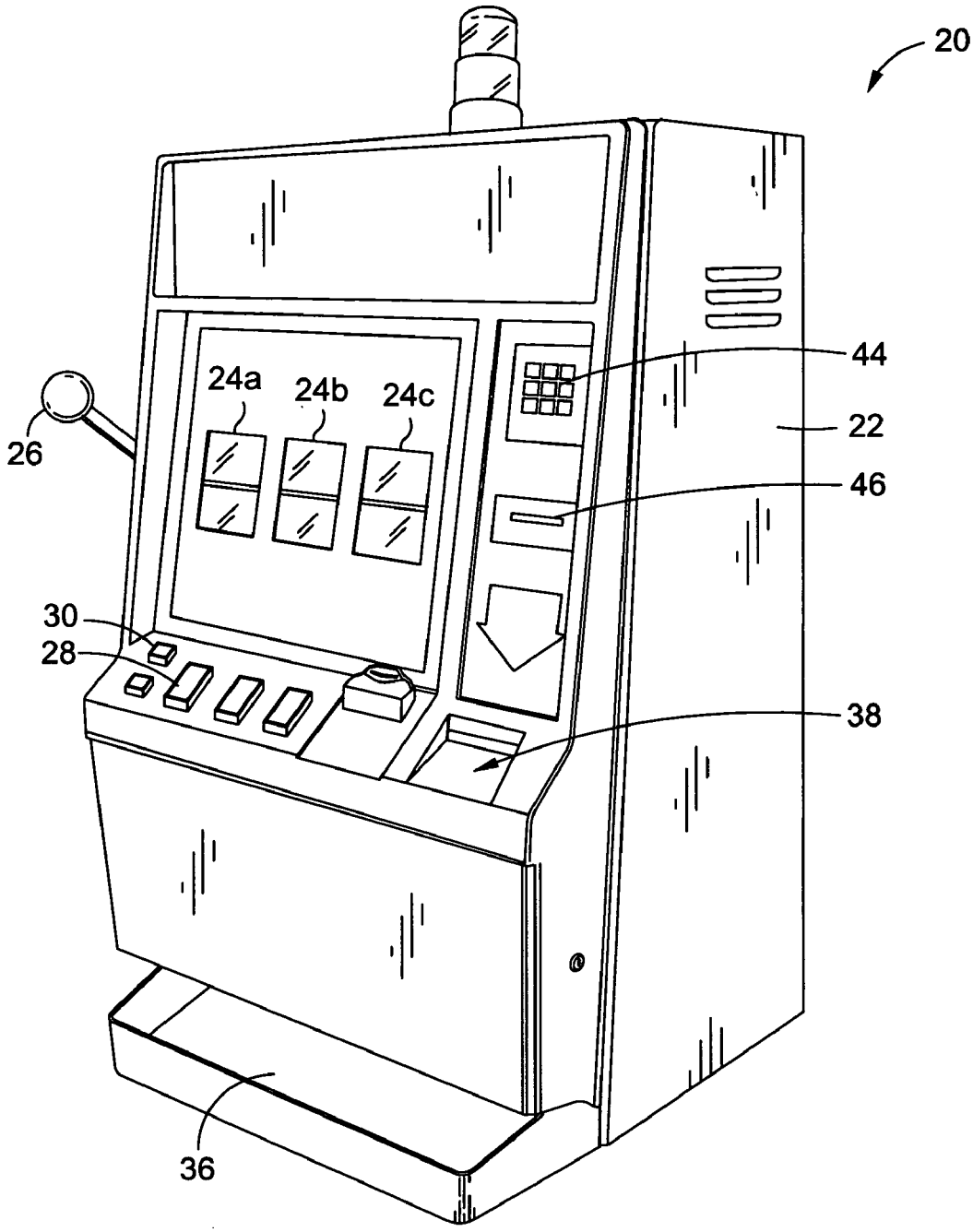
FIG. 1 is a perspective view of a gaming machine in accordance with one embodiment of the invention.

Referring to FIG. 1, a gaming device or machine 20 includes a housing 22 containing or supporting various components. The gaming machine or device 20 is, either alone or in combination with other devices, preferably configured to present a game, such as a game of the invention. It will be appreciated that the housing 22 may have a variety of shapes and configurations. For example, the gaming machine 20 may be configured as an "upright", "bar-top" or "slant" style gaming machine, which configurations are well known in the industry.

As illustrated, the gaming machine 20 includes means for displaying symbols or indicia utilized in the play or presentation of a game. In a preferred embodiment, the gaming machine 20 includes three mechanical reels 24*a,b,c*. In a preferred embodiment, the reels 24*a,b,c* are utilized to present or play a base or main game or event, and as such are referred to generally herein as "main game" reels.

Such reels 24*a,b,c* are well known, and comprise a body having one or more indicia or symbols printed thereon. The reels 24*a,b,c* may have a number of positions or locations which bear or do not bear (i.e. comprise a "blank" position) indicia. The indicia or symbols which are borne by the reels 24*a,b,c* may vary. Preferred examples of symbols for use in playing games of the invention are described in detail below.

The various combinations of indicia displayed by the reels 24*a,b,c* preferably have significance to or relate to the outcome of a game presented at the machine 20. For example, certain combinations of indicia may comprise a non-winning combination. Preferably, one or more combinations of the indicia when displayed as a result of a spin of the reels 24*a,b,c* are designated as a winning combination of indicia. The number of winning combinations may vary dependent upon the desired payout or winning percentage to the players as compared to that which is retained by the game operator. In one or more embodiments, at least one of the same indicia is contained on each of the reels 24*a,b,c*, and at least one winning combination comprises all of the reels 24*a,b,c* displaying that same indicia.

Means are provided for rotating the reels 24*a,b,c*. In one or more embodiments, the means may comprise a mechanical linkage associated with a spin arm 26, with movement of the spin arm (a "pull") by a user causing the reels 24*a,b,c* to spin. In such an arrangement, the reels 24*a,b,c* are generally allowed to free-wheel and then stop. In another embodiment, electronically controlled mechanisms are arranged to rotate and stop each reel 24*a,b,c*. Such mechanisms are well known to those of skill in the art. In this arrangement, actuation of the spin arm 26 or depression of a spin button 28 causes a controller (not shown) to signal the activation of the spin mechanism associated with one or more of the reels 24*a,b,c*. Preferably, the controller is arranged to either turn off the signal to the device(s) effecting the rotation of each or all of the reels 24*a,b,c*, or generates a signal for activating a braking device, whereby the reels 24*a,b,c* are stopped. As is well known, the combinations of reel positions and their odds of hitting are associated with the controller, and the controller is arranged to stop the reels 24*a,b,c*, in a position displaying a combination of indicia as determined by the controller based on the combinations and odds. The principal of such an arrangement is described in U.S. Pat. No. 4,448,419 to Telnaes, which is incorporated herein by reference.

The gaming machine 20 preferably includes one or more player inputs which permit the player to interact with the gaming machine 20. In the embodiment illustrated, the gaming machine 20 includes a plurality of push-buttons. As described above, one such button may comprise a "spin" button 28. As also illustrated, buttons or similar input devices may include a "bet" button 30 or other buttons or inputs.

A wide variety of other inputs may be provided, varying both in form and function. For example, in one embodiment, one input may comprise a "touch screen" type display. Other inputs, such as rotatable arms, joysticks, keyboards or keypads, or other inputs may be provided. Each input preferably provides input, such as by way of an electrical signal, to the gaming controller or other game content generating device. In that manner, game play is interactive.

In one embodiment, the gaming machine 20 is configured to present a game only upon a player placing a bet, wager, or other payment. Thus, the gaming machine 20 may include means for accepting value, and preferably, monetary value. As illustrated, the gaming machine 20 may include a coin acceptor (not shown). The coin acceptor may be configured to accept coins of one or more denominations. A coin sorter, coin hopper and other coin holding and processing devices may be located in the housing 22 of the gaming machine 20.

The gaming machine 20 may also or alternatively include a bill validator (not shown). The bill validator may be configured to accept paper money of one or more denominations. A bill stacker and other bill processing and storage devices may be located in the housing 22 of the gaming machine 20.

The gaming machine 20 may also or alternatively include a ticket reader, smart card, credit card or other media acceptor/reader. Such devices may be utilized to obtain information regarding value, such as credit card account information or bar-coded ticket value. When value is provided to the gaming machine 20, the gaming machine 20 may be configured to display information regarding the provided value, such as in the form of "credit" information. This information may be displayed, for example, on a display of the gaming machine or one associated therewith.

The player may utilize inputs to place a wager, bet or provide payment to play a game. For example, a player may depress the "bet" button 30 to bet or wager one or more credits.

In one embodiment, the gaming machine 20 is configured to award winnings for winning outcomes of games played. The winnings may be paid or provided to the player in a variety of manners. In one embodiment, awards may be indicated in the form of credits. Thus, when a player wins, the total number of credits belonging to them is increased, and the increased amount may be displayed to the player. The player may utilize the awarded credits to play future games.

In another embodiment, the player may be awarded money, or may convert credits to money. As illustrated, the gaming machine 20 may include a coin tray 36 into which coins may be dispensed. The coins may represent a specific award. Alternatively, the player may utilize a "cash out" button or input (not shown) and be paid the value of their credits in the form of coins.

Other forms of payment may be provided, such as by issuance of a ticket which represents value. As illustrated, the gaming machine 20 includes a media dispenser such as a ticket printer 38 for printing and dispensing a medium bearing information regarding value.

Non-monetary prizes may also be awarded. For example, credits may be redeemed for prizes or a ticket or tickets may be redeemed for specific prizes or general prizes. In other embodiments, game play may be for entertainment purposes only and no prize or award may be won or awarded. In one embodiment, a player may win points which the player can accrue and use, such as for free game play. In another embodiment, no payment need be provided. For example, the game may be played for recreational purposes only. In other embodiments, points may be awarded, the points having no "value," except to provide the player an indication of the level of success of play of the game. Such a level of points may be compared, for example, to the level of points achieved by other players. It will be appreciated that instead of mechanical reels 24*a,b,c*, other means may be utilized to display symbols, indicia or other information regarding play of the main game. For example, such indicia could be displayed by a video display. The display may be of a variety of types now known or later developed, such as DLP, CRT, plasma, LCD or others.

Preferably, means are provided for controlling the operation of the gaming machine 20, such as the reels 24*a,b,c*. In one embodiment, that means comprises a gaming controller. The gaming controller may be configured to track game credits (including value provided to the gaming machine and bets placed), initiate the rotation and stopping the reels 24*a,b,c*, and, as detailed below, initiate bonus events including generating information for display by the display 38. In one embodiment, a gaming controller includes a processor and a memory. The memory stores software which is executed by the processor. In one embodiment, the gaming controller is located inside of the housing 22 of the gaming machine 20.

In another embodiment, the operation of the gaming machine 20 may be controlled in whole or in part from a remote location, such as a remote server. For example, game data may be generated remotely and be transmitted to the gaming machine 20 for display. The game data may then be downloaded to the gaming machine 20 via a wired or wireless communication link.

In one embodiment, the gaming machine 20 also includes an input in the form of a keypad 44. The keypad 44 is configured to accept input from a player, such as numbers, letters or a combination thereof. In one embodiment, the keypad 44 permits the input of the numbers 1, 2, 3, 4, 5, 6, 7, 8, 9, and 0, as well as the symbols # and *, in similar fashion to the keypad of a touch-type telephone. This keypad 44 may be associated with a card reader 46, such as a card reader of a player tracking system. As is well known, in such a system, a player may identify themselves (such as by input of a card bearing information). Awards may be provided to the player associated with their play.

The gaming machine 20 illustrated and described is just one embodiment of a device which may be used to present a game in accordance with the invention. Other devices may be utilized. For example, the gaming machine 20 may also comprise a computing device, such as a laptop or desktop computer. Game information may be transmitted via a communication link to a remote player. The communication link may include, for example, the Internet. The game information may be utilized by the remote player's computer, such as by displaying game information on an associated screen. A player may provide input via a keyboard, mouse or other input device.

Various aspects of the games of the invention may be presented at other than a gaming machine. For example, as described below, various features of the invention may be implemented in conjunction with a table game.

Figure 2:
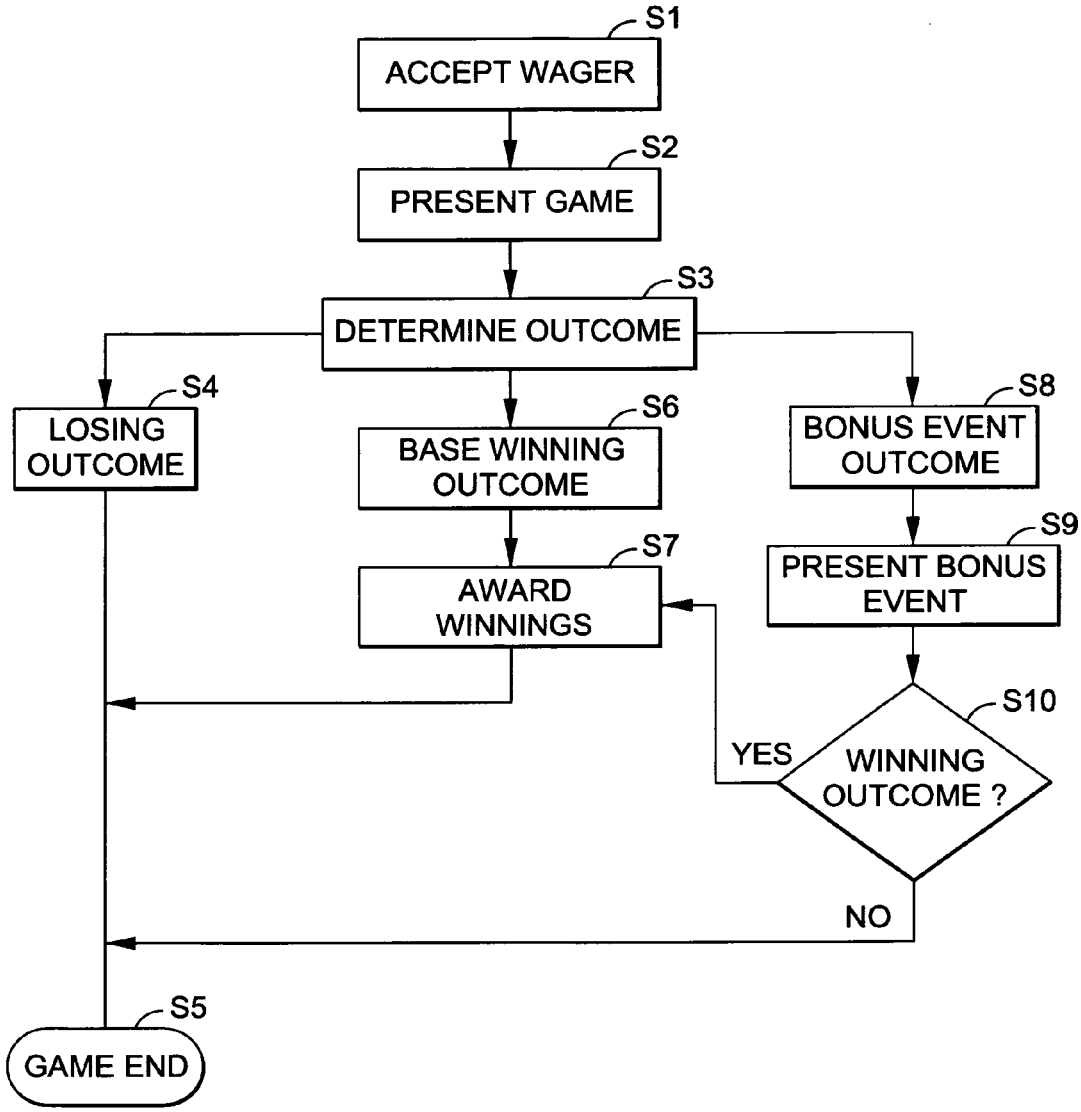
FIG. 2 is a flow-chart illustrating one embodiment of a method of playing a game in accordance with an embodiment of the invention.

One embodiment of a game of the invention will now be described with reference to FIG. 2. In a preferred embodiment, a game is presented as a wagering game. In such a configuration, a player wagers value for the opportunity to be awarded winnings. Of course, the game, or at least portions thereof, may be played for entertainment only, with the player not required to wager value. In the wager format, as illustrated, in a step S1 the player places, and the gaming machine accepts, a wager. As described above, if the wager is in the form of monetary value, the wager may be placed in a variety of fashions. In one embodiment, a player inputs currency, coins or a medium representing or associated with such value, such as a coded ticket, credit/debit card or the like. The value may be credit to the machine, the player then placing a wager specifically for a game using the "bet" button. In that case, the number of credits belonging to the player is reduced by the amount of the bet.

In response to the wager, the game is then presented, as in step S2. In one embodiment, this step comprises the gaming machine presenting a base game. In one embodiment, this game comprises the random selection of a game result or indicia representing a game result, which results preferably comprises a winning or losing game result. In the case of the gaming machine 20 described above, the base game comprises the rotation of the reels 24*a,b,c* to a stopped position in which they display a set of symbols or indicia. This set of indicia represents the outcome of the base game.

In one embodiment, if the selected result or the selected indicia which appear in specific locations, such as along a payline, comprise a winning indicia or winning combination of indicia, then in a winning outcome is declared. As indicated below, there may be a number of winning combinations, one or more of which trigger different outcomes or results.

In the embodiment illustrated, the game is presented on three reels 24*a,b,c*, each configured to display at least three symbols. There may be as few as one or multiple paylines. In one configuration, the number of paylines which are activated is dependent upon the size of the player's wager. For example, if the player places a wager of a single amount, such as a single coin or credit, then a single payline may be activated. In that instance, only indicia appearing along that single payline are considered in determining the outcome of the game. Additional coins or credits wagered may activate additional paylines. A maximum bet, such as five coins or credits, may activate all of the paylines.

In a step S3, the outcome of the base game is determined. In one embodiment, this comprises determining if the one or more indicia or symbols, such as along one more paylines are winning or losing combinations. As described above, in one embodiment, the outcome of the base game is known when the game is initiated, (such as by random generation of a number by the gaming controller (or a random number generator associated therewith), that number corresponding to a particular possible outcome), and before the reels are rotated or before they stop. In this configuration, the outcome of the game is known even before the reels stop spinning, and actually, the stopping position of the reels is determined by the then known outcome of the game. The game may have a number of outcomes. In one embodiment, it may be determined that the outcome is no winning symbol or combination of symbols (such as along an active payline), as in a step S4. In such event, the game may end, as in step S5. In a preferred embodiment, if there is no winning combination, the player loses their wager and they are paid no winnings.

In one embodiment, as in step S6, it may be determined that the outcome of the game is a particular winning symbol or combination of symbols comprising a base win. For example, one or more symbols or combinations of symbols may comprise a winning result which entitles the player to a winning. In such event, as in step S7, the player may be awarded a winning. The winning may be awarded in a variety of ways and may comprise a number of things. In one embodiment, the winning comprises monetary value. The size of the winning may depend upon the size of the player's wager and/or the probable frequency of receiving the particular winning combinations, among other factors. In one embodiment, the winning is awarded to the player in the form of credits. The player may elect to "cash out" those credits from the machine, such as by requesting that a value ticket be printed by the printer, or by dispensing coins to the coin tray, among other ways. After the player is paid their winnings, the game preferably ends at step S5.

In one embodiment, as in step S8, it may be determined that the outcome of the game is a particular winning symbol or combination of symbols entitling the player to play a bonus event. If a bonus event outcome is received, a bonus event is preferably initiated, as in step S9. If the outcome of that event is determined to be a winning event, winnings may be awarded, as in step S7. If not, the game may end at step S5.

In one embodiment, the bonus event is a timed bonus event. One embodiment of such an event will be described with reference to FIG. 3. In a step S301, a game play time is initiated. In one embodiment, the game play time may be fixed. In other embodiments it may be randomly selected or determined through some secondary event. Preferably, the total time of the event and the time remaining in the event are displayed to the player, as in step S302. In the case of an embodiment of a gaming machine, such as illustrated in FIG. 1, the gaming machine 20 may include a timer. The timer may be a digital display, mechanical timer or the like. As illustrated, the timer is located in a top box portion of the gaming machine, but is could be located elsewhere. In addition, the time information could simply be displayed on another display of the gaming machine.

Preferably, the event starts at a step S303, with the timer displaying remaining time as the time of the event expires. In one embodiment, the event is the play of a slot game, such as a video slot game presented on a display of the gaming machine or a reel slot game presented via the reels of the machine illustrated in FIG. 1.

For example, the game may comprise a five (5) reel, nine (9) payline video slot machine which traditional symbols. Such games are well known in the art. Preferably, during the active time period, the player may press the "spin" button to initiate the game. The outcome of each spin is determined to see if the result was a win or loss. Preferably, certain symbols or combinations thereof when occurring along one of the paylines, is deemed a winning combination, as is known in the art.

Game play ends in a step S304 when the time expires. In a step S305, the total bonus award is determined and awarded to the player. For example, a player might play 14 games, with 5 of the games yielding winning combinations with associated winning values of 10, 100, 400, 5 and 20, for a total winning of 535 during the event. After the bonus award is paid to the player, the game ends.

Several specific examples of preferred variations of timed gaming events will now be described in greater detail. As indicated above, one embodiment of a timed bonus event defines a time period during which one or more players are permitted to play games without placing a wager, but still offering the players winnings for winning outcomes of the games played during the duration of the event.

In one embodiment, a timed gaming event defines a duration of time during which enhanced payouts are awarded. The timed gaming event may be associated with a single gaming machine or a group of two or more gaming machines. During the event, payouts for winning outcomes for games played by players may be enhanced, such as subject to a multiplier or other increase. Each player of a machine subject to the timed gaming event preferably places a wager to play one or more games, such as by way of monies, credits or comps (such as use of player points). The outcome of one or more of the games played during the timed gaming event are preferably subject to the enhanced winnings.

Figure 4:
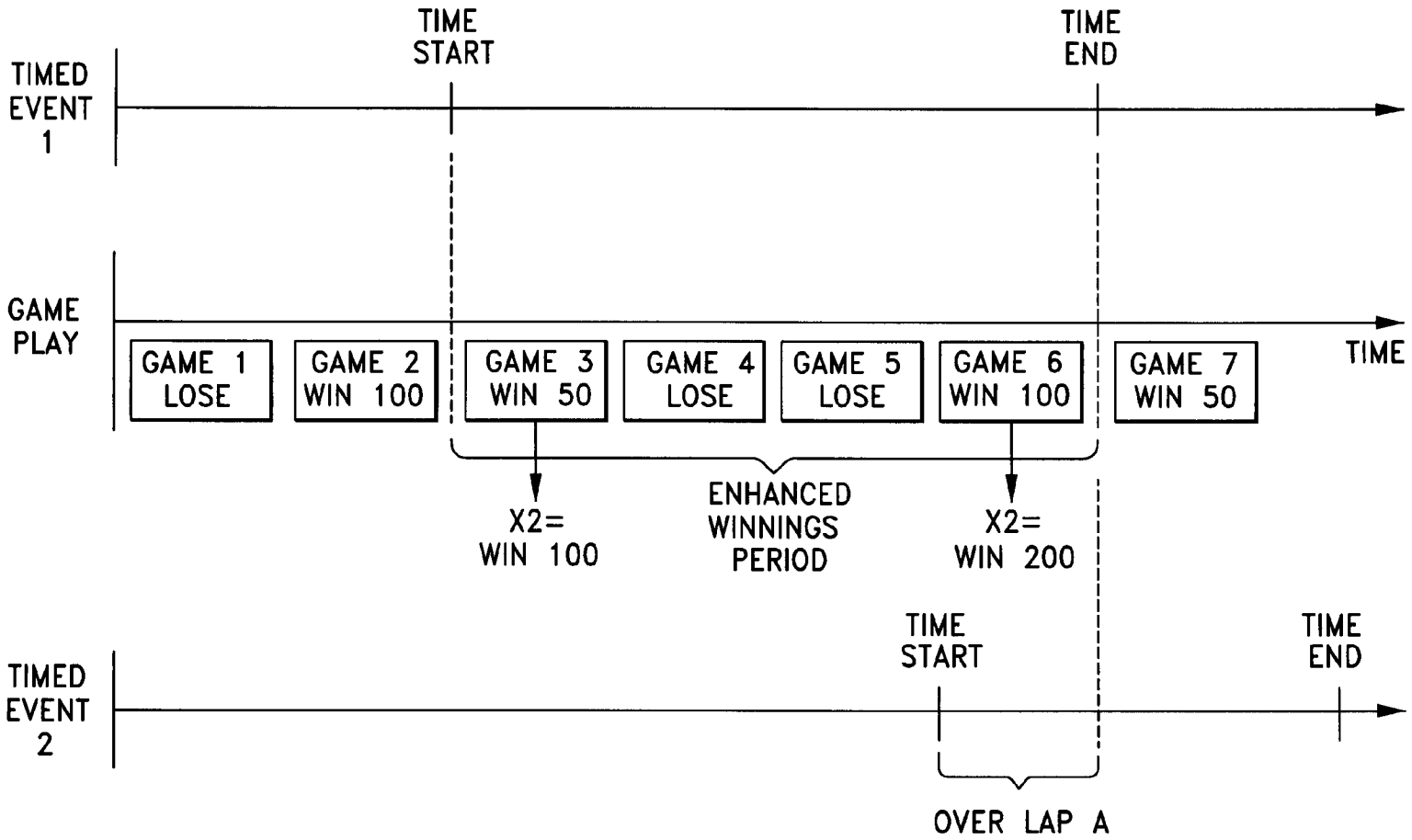
FIG. 4 illustrates one embodiment of a timed gaming event in accordance with the invention.

FIG. 4 illustrates one such embodiment of the invention. As illustrated, a player plays a gaming machine. After playing a Game 1 and a Game 2, a timed gaming event comprising an enhanced award time period is initiated. During that time period, the player plays Games 3, 4, 5, and 6 . As illustrated, for winning outcomes of Games 3 and 6 during that time period, the player's winning payouts are enhanced by a 2× multiplier. After the timed event ends, the player's winnings for Game 7 remain the normal payout (and are not enhanced). It is noted that the multiplier value may be other than 2× and could vary over time (such as for each bonus game played).

In one embodiment, a timed gaming event may comprise a tournament type event. Players of two or more machines play one or more games for outcomes. In one embodiment, players of two or more machines play a plurality of games during a timed period. The player with the highest winnings (or other criteria, such as points or most games won) for games played during the time period is declared the winner and is awarded a payout, such as their actual winnings and/or enhanced winnings, such as including a tournament win bonus. In one embodiment, the timed event is run as a tournament where players play dedicated machines, with the machines activated at the start of the timed tournament event. In another embodiment, the tournament could be applied to existing machines where play is already occurring. For example, a plurality of players may play a plurality of gaming machines. At a particular time or times, a tournament may be announced to the players of those machines, the tournament "overlapping" with their existing game play.

Figure 5:
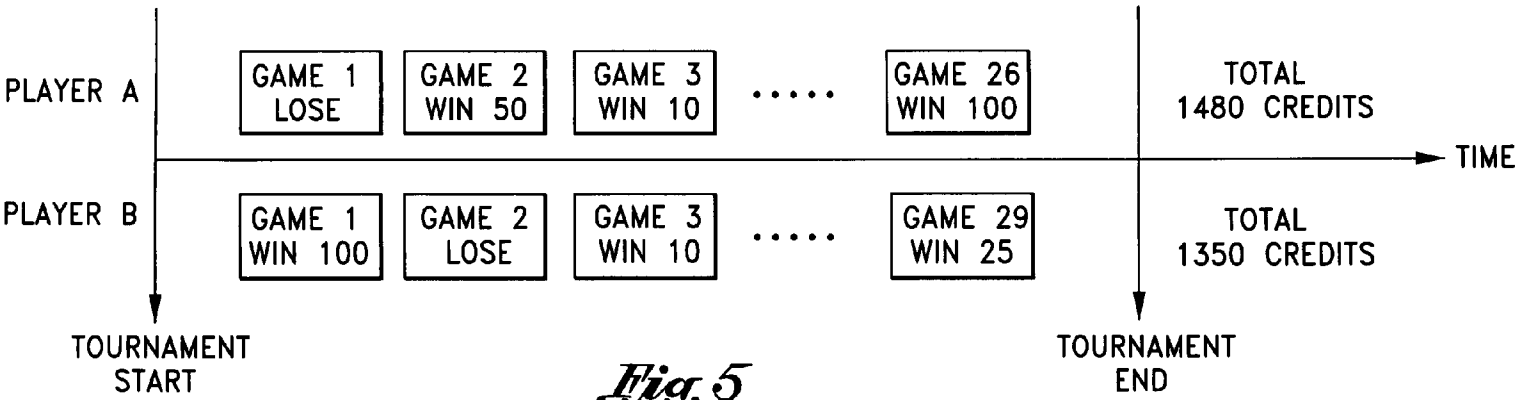
FIG. 5 illustrates a timed tournament type gaming event in accordance with the invention.

FIG. 5 illustrates one example of such a tournament. As illustrated, during the timed event tournament period, at least two players (Players A and B as illustrated in FIG. 5) play a plurality of games. The outcome for each game is determined. The outcome of the event is preferably dependent upon the outcomes of the game(s) played during the bonus event, such as the total win or credits for winning outcomes for games played by the player. The winner or winners of the timed event may then be determined from each individual player's outcome. In the example illustrated, if the winner of the tournament is the player having the highest aggregated win value, then Player A may be declared the winner of the event. All players may be paid their actual winnings, or only the winner (s) may be paid winnings, whether a tournament prize and/or such a prize and the actual win. Of course, the tournament may have a variety of features. For example, the player having the greatest "loss" for games played during the timed period or other criteria may be used to determine the outcome of the event. Preferably, however, the event comprises the play of multiple games during a time period which has a start and an end defined by a time duration, and the outcome of the event is determined at least in part based upon each player's own aggregated play during the time period.

Figure 6:
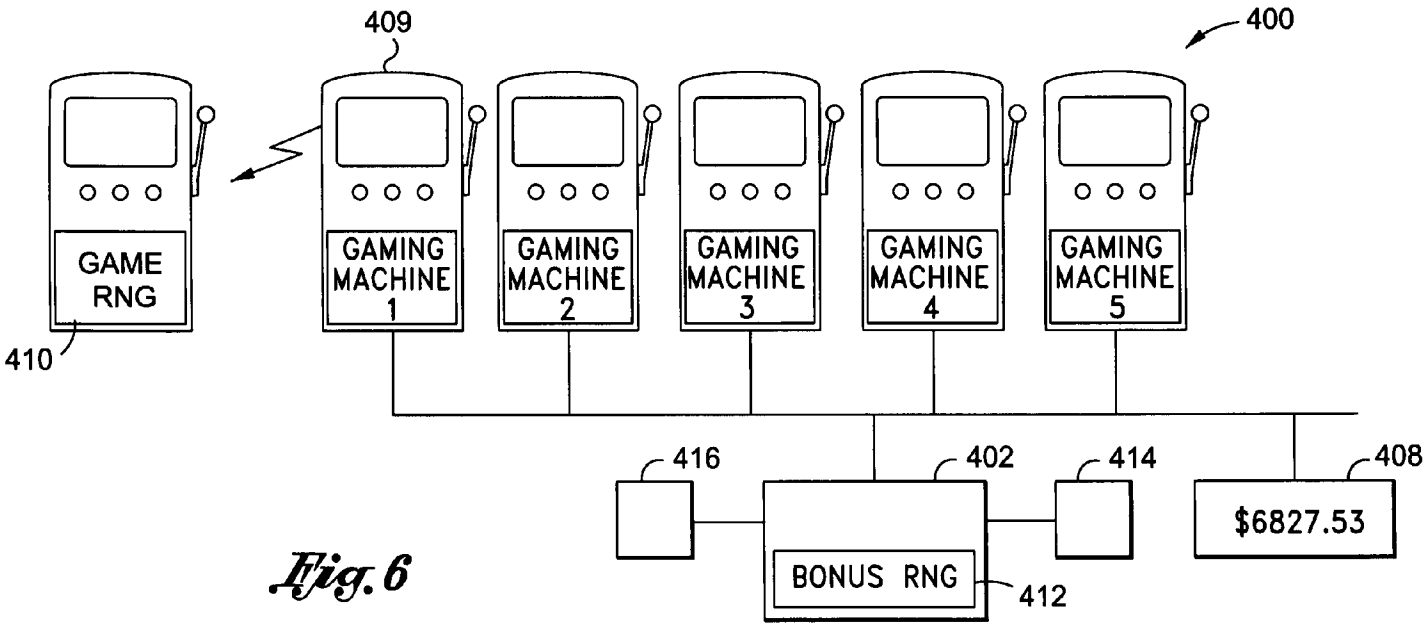
FIG. 6 illustrates a system for presenting a timed gaming event in accordance with an embodiment of the invention.

In one embodiment, the machines associated with the timed gaming event are linked or associated with a bonus event server. In the case of the tournament, for example, a bonus event server may automatically track winnings and losses of the multiple players so that at the end of the event the winner can be automatically declared and winnings credited directly to their machine. FIG. 6 illustrates one embodiment of a system 400 comprising a bonus event server or host 402 which communicates with a plurality of gaming machines 404. In such an embodiment, the timed gaming event may be triggered or initiated from the bonus event server 402. In other embodiments, the event could be triggered directly at the machine.

In one embodiment, players may play for a "progressive" tournament award. For example, a portion of wagers at one or more machines or associated with the play of one or more games may be assigned to a pool. When the tournament timed event is played, the players may play for all or a portion of that pool. Likewise, such a pool may be associated with a single gaming machine and a player of the machine may play to win all or a portion of the "machine" pool when an enhanced winnings timed event is declared at that machine. As illustrated in FIG. 6, the tournament award may be posted at one or more times to players, such as by the bonus event server 402 transmitting information to one or more displays 408. The information might comprise bonus award information, bonus event player standings, bonus event time remaining or other information, as further detailed below.

In one embodiment, the bonus event server 402 is configured to monitor the gaming machines 404 and present the bonus event. For example, each gaming machine 404 may have its own random number generator 410. In this manner, each gaming machine 404 may be configured to present base games. Of course, the gaming machines 404 could have other configurations, such as to be configured to be controlled in a server environment wherein game results are generated remotely and merely presented at the gaming machine.

In one embodiment, the bonus event server 402 may monitor game outcomes and other events, such as the amounts of wagers placed and the like, at the gaming machines 404. In one embodiment, the bonus event server 402 determines when a bonus event is to be initiated. This might be when the bonus event server 402 determines that a gaming machine 404 has presented a base game having a bonus event triggering outcome, or when the bonus event server otherwise determines that such an event should be initiated.

Preferably, the bonus event server 402 has its own random number or "outcome" generator 412. In this manner, the bonus event server 402 is configured to independently determine the outcome of the bonus event. In one embodiment, as detailed below, the bonus event server 402 may be configured to change the odds of a bonus event trigger based upon the number of games or gaming machines in play. The random number generator 412 may comprise software and/or hardware for generating random numbers that correspond to outcomes or events (such as a "bonus trigger" or "no bonus trigger"). In one embodiment, the random number generator 412 may be dynamic (or there might be more than one random number generator associated with the server), capable of generating different sets of numbers (like numbers 1-150 or 1-300 or 1-450, such as to change the potential odds of an event) or may be linked to particular outcome or pay tables. Various examples of this configuration will be provided below.

The bonus event server 402 may communicate with a player loyalty server or system 414, such as for updating points which are awarded to players. The bonus event server 402 might also communicate with an accounting server or system 416, such as to update gaming machine winnings, progressive awards or the like. It will be appreciated that the servers may comprise hardware and/or software, such as a computing device having one or more communication ports. It will also be appreciated that one or more of the servers may be the same. For example, the bonus event server might also serve as the player loyalty server, that server configured to implement both the functions of presenting bonus games and tracking player points and the like.

Another embodiment of a game in accordance with the invention will be described with reference to FIGS. 5 and 6. In this embodiment, players may play base games on individual gaming machines 404. Preferably, the bonus event server 402 monitors the gaming machines 404, such as for game outcomes, wager amounts, time between games played, whether the player is using their player loyalty card, and/or other activities. In the event a game played at one of the gaming machines 404 results in a bonus event trigger, or in the event the bonus event server 402 determines a bonus event trigger, then a bonus event is initiated. In one embodiment, for example, the bonus event server 402 may be configured to trigger a bonus event on average once every 150 games played at each gaming machine. In such event, the random number generator 412 may be configured to randomly select a number between 1 and 150. When the number of games played at a gaming machine reaches that selected number, the bonus event may be triggered (for example, the random number generator may select the number 42, in which case the bonus event is triggered when 42 games have been played at the gaming machine 404). In one embodiment, if the number of active or qualifying gaming machines 404 increases, the random number generator 412 may be configured to change dynamically so that the odds of receiving a bonus event trigger is commensurate with the number of active machines. For example, if there are two active gaming machines, thus doubling the number of games being played, the random number generator 412 (which may include pay or event tables) may be configured to then select a number between 1 and 300. In this manner, the "hit" frequency is halved, but since the number of active or qualifying gaming machines is doubled, the odds of receiving a bonus event trigger is still the same (1 to 150). Of course, such a principle may be applied to numbers of gaming machines beyond 2. In general, the bonus event server may be configured to trigger a bonus event every Nth game per machine, where the number N is increased by the number M machines in play (for example, if N=150 for 1 machine, N=300 for two machines). Stated another way, if the probability of a bonus game is 1 in 1000, then the bonus event controller probability for a bonus trigger is 1 in (1000*M), where M is the number of machines (or games or players) in play (thus if the probability of a trigger for 1 active machine is N, then the probability of a trigger for M active machines is N/M).

Figure 3:
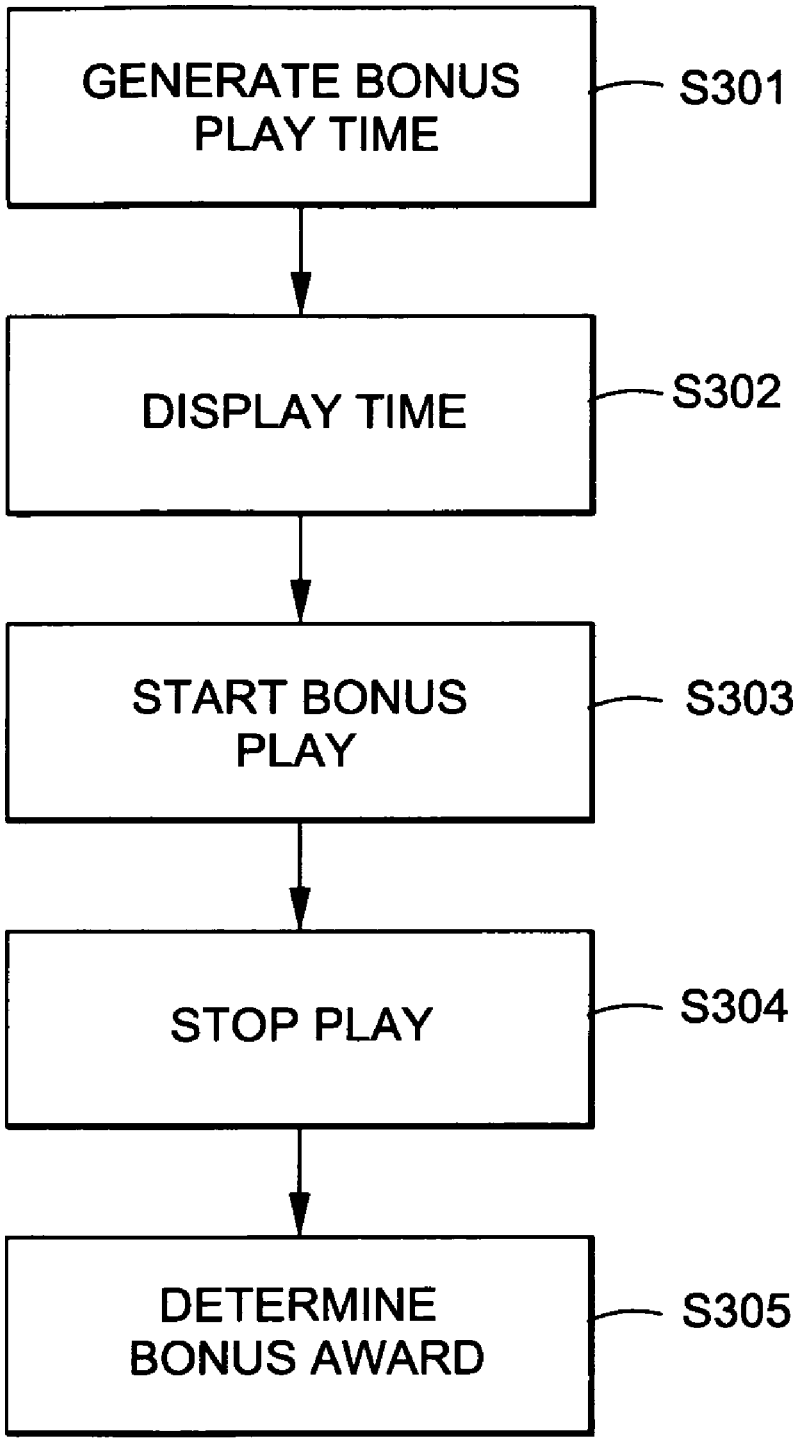
FIG. 3 is a flow-chart illustrating one embodiment of a bonus event in accordance with an embodiment of the invention.

In one embodiment, when a bonus event is triggered, a timed bonus event is initiated, similar to that detailed above relative to FIG. 3, but in a tournament mode as described above relative to FIG. 5. In one embodiment, all qualifying or active gaming machines 404 associated with the bonus event server 402 go into bonus mode upon a bonus event trigger. In this regard, in one embodiment only certain players/gaming machines may be eligible for bonus event play. For example, a player may be required to identify themselves, such as with their player loyalty card, in order for the machine to qualify for the bonus event. A player might also be required to place a maximum bet and/or play games within certain time intervals for the gaming machine to qualify. For example, a player might be required to play subsequent games no more than 15 seconds after a previous game in order for the gaming machine to not be viewed as "idle" to the bonus event server 402. As indicated, the bonus event server 402 may monitor such activities in determining which gaming machines are entitled to enter the bonus mode. Preferably, all gaming machines which qualify for the bonus event enter the bonus event once the bonus event is triggered (which trigger might come from any qualifying active gaming machine). In this configuration, any of the gaming machines 404 of the system 400 may trigger the bonus event.

As indicated, the bonus event server 402 may provide various information to players, such as via one or more common displays 408 or directly to the gaming machines 404. This information might comprise information regarding leaders during the bonus event (such as by points/credits), remaining time in the event, various animation, and when the gaming machines are not in bonus mode, features such as attract messages and the like. The bonus event server 402 might also drive various sound generating devices, such as bells, speakers or the like, and/or lights, for producing various music, attraction sounds, etc.

In one embodiment, if more than a certain number of gaming machines are active, then the bonus event may be extended from the base time as to one or more of the leaders at the end of the base time. For example, if there are at least three players in the bonus event, then additional time might be awarded to the leader at the end of the original bonus time. In this manner, the leader may be provided an additional bonus award (while the other gaming machines go back to their normal or base mode).

In this regard, in one embodiment all wins during the bonus event period may be enhanced. For example, during the bonus event, each gaming machine may be configured to present the same game (such as slots, video poker or the like) as in the base mode. However, awards for game wins may be doubled or otherwise modified/increased. In this regard, the bonus event may be referred to as the "double jackpot time" game.

In one embodiment, players of the bonus event may be permitted to participate for progressive awards, jackpots or other winnings different than those available when playing the base game. For example, a progressive may be generated from a portion of base game wagers. This progressive may be awarded to the winner of the bonus event.

Another embodiment of a game of the invention may comprise a video poker type bonus event. In this configuration, the bonus event server 402 may be associated with one or more gaming machines 404 which are configured to present video poker games. Of course, those gaming machines might be configured to present other games.

In similar fashion to the game described above, a bonus event might be triggered at one or more qualifying gaming machines. When a bonus event is triggered at any one gaming machine, all qualifying machines might enter the bonus mode or event.

In one embodiment, the bonus event might be configured for certain times, such as to occur daily, weekly or monthly. In this regard, the bonus event server might be configured to trigger the bonus event, such as at a randomly selected time each day.

Preferably, the bonus event is a "tournament" type event as detailed above. In one configuration, however each player is awarded points for games played during the bonus event. The leader(s) and/or winner(s) may be those players who accumulate the most points during the bonus event. Those points may be treated as player loyalty points, such as associated with a casino's player loyalty program. Such points might be used for free or reduced cost goods or services and the like, as defined by the casino's player loyalty program. The points might be usable for the play of free games, including games offered remotely, such as on-line.

In one embodiment, the winner (or winners, if more than one winner is declared) may be awarded the points they accrued during the bonus event. The other (non-winning) players may or may not be awarded their accrued points. In one embodiment, the winner(s) may also be awarded cash or other prizes, including a progressive or jackpot.

In a preferred embodiment, in order to qualify for the bonus event, the player must identify themselves, such as by providing their player loyalty card (such as to a card reader of the gaming machine). In this manner, the player's play, including any accrued/awarded points, may be associated with the player. In this regard, in one embodiment, referring to FIG. 6, the bonus event server 402 may be in communication with the casino's player loyalty server/system 412 so that accrued or awarded points may be transmitted to the player loyalty system and associated with the player's account.

Of course, the points might be awarded in other fashions, such as by printing on a ticket or storage on a card which is coded or issued at the machine and dispensed to the player for the player's use.

In one embodiment, the points which are awarded to the player may be special points other than player loyalty program points. These points might have no cash value and might only be usable in specific situations. For example, the points might only be redeemable for free game play or particular prizes at the casino. In one embodiment, for example, the points might only be used for free game play. A player might use the points to play games at the casino or even play remotely, such as games on-line or via a hand-held device.

In one embodiment, a player may utilize the points or other award elements for the remote play of gaming machines. For example, a player might log in or register with the system and be permitted to play one of the gaming machines remotely. The player might use their award points as "credits" to play the game. In other embodiments, the game could simply be presented via a hand-held or remote device (such as on the display of a home computer) using information provided by the system. In such embodiments, the player might use a "bank" of award points in exchange for play. The player may be permitted to check their player loyalty or other award account remotely, such as to determine the number of available points or credits for such play. The player might also be provided notifications, such as via text, SMS, Instant Messenger, email or the like, when the player uses points or awards in game play. In this manner, the player can confirm their points and the use of their points in remote game play.

Leaders of the bonus event may be posted. One or more bonus events might comprise a compilation of individual bonus events. For example, a weekly bonus event might comprise the compilation of daily bonus events. In this configuration, the winner of the "weekly" bonus event might comprise the player or players who accrued the most points during each of the bonus events during a particular week. The bonus event server may track the bonus event play of each player during each bonus event during the period and aggregate their play to determine the winner. Of course, such a principle might apply to weekly, monthly, yearly or other bonus event periods. Alternatively, a weekly (or other) bonus event might be played only by those players who were winners of a daily (or other) bonus event.

The timed gaming events may have a variety of configurations and implementations. In one embodiment, a plurality of timed gaming events may occur simultaneously. For example, a timed event may be declared during which all winning outcomes at the machine are subject to a 2× bonus payout. Before that timed event concludes, another timed event may be initiated. FIG. 4 illustrates one such embodiment in which a second timed event has been initiated before the conclusion of a first timed event, resulting in two timed events overlapping for time duration A.

In one embodiment, only games which are initiated after the start of the timed gaming event and which conclude before the end of the timed gaming event comprise part of the timed gaming event (such as for determining the game outcomes subject to a tournament score or enhanced payouts). In another embodiment, if a game is in play when the timed event starts or ends, then that game is considered to be part of the timed event.

Several additional embodiments of timed gaming events will now be described in conjunction with the above-described game of the invention. It will be appreciated, however, that these events and various features thereof have applicability to other games, whether slot-type games, video poker, bingo or other games.

In one embodiment of a game of the invention a player may be awarded a "free spin" bonus event, as illustrated in FIG. 3. In another embodiment of the game, the event may be a tournament type timed gaming event. In one embodiment, if the player receives a particular outcome playing the base game, the bonus event may be initiated. The player may be instructed to select one of those symbols or a symbol from a different set of symbols. Selection of a symbol by the player might reveal the time period for a timed gaming event. For example, the player may be eligible to receive a time period of play of 30, 45, 60, 75 or 90 seconds. In other embodiments, the duration of the timed event might be randomly generated or it might be fixed (such as by the bonus event server).

In other embodiments, the bonus event could be terminated by other than the expiration of time. For example, in one embodiment one or more particular bonus event outcomes might end the bonus event. In other embodiments, a player or players might collect certain symbols. Upon reaching a threshold of those symbols, the bonus event might end. In an embodiment particularly suited to a tournament bonus game, players might be given the opportunity to play a certain number of bonus games as quickly as possible. Upon one of the players reaching the number of games, the bonus event might end. For example, players might be given the opportunity to play up to 25 games. One player might reach the $25^{th}$ game while other players have only played 20, 19 and 11 games, respectively. Nonetheless, the bonus event might end at that point. In such an embodiment, graphic information might be displayed to indicate to the players how close one or more players are to the game ending event, so that they may gauge their performance accordingly. In yet other embodiments, the bonus event might end when a player or players reach a particular credit or accrued winnings threshold.

In one embodiment, once the time period of the timed gaming event is determined, the player may be permitted to play as many bonus games as possible during the time period. These games may comprise, for example, slot or video poker games. The player is preferably required to place a wager to play each game, and is awarded winnings for winning outcomes of the game. In other embodiments, the player might be required to pay to play each game. For example, as to a bonus event which awards a player accrued points, regardless of whether they are declared the winner of the bonus event, the player may be required to place a wager to play each game during the bonus event. In one embodiment, if the player runs out of credits during a timed gaming event which requires the player to place wagers to play games, the player may be permitted to "pause" and "restart" the game in order to provide additional monies to the gaming machine.

In addition, in one embodiment, the player may be awarded an award based upon the results of their games during the timed period. For example, the player may be awarded a bonus if their total winnings for games played during the timed gaming event reach particular monetary levels. The player might play, for example, for first, second and third place prizes, the prize amounts varying depending upon the size of the wager. In one embodiment, only a single winner may be declared of a bonus event. In others, players might be ranked and be awarded on or more prizes or awards, or shared in one or more awards.

In one embodiment, the maximum wager a player can wager upon games during the timed gaming event is limited to the size of the wager the player made to play the game which resulted in the winning outcome which triggered the timed gaming event. For example, if the player placed a wager of 2 (two) coins or credits to play the base game and the timed gaming event was triggered, then the maximum bet the player could place upon games during the timed gaming event would be 2 (two) credits. This may then limit the size of awards for winning outcomes of games played during the bonus event.

In various embodiments of timed gaming events, the speed of game play may be altered. For example, during a timed gaming event, the number of games which are presented during a period of timed or the length of time of the presentation of a game, may be altered or controlled by the gaming machine. For example, during a timed gaming event comprising slot type games, the length of time that the reels spin before stopping (whether physical or virtual reels) may be increased, thus reducing the number of games that can be played in a particular period of time.

The games of the invention may include an "auto play" feature. If a player activates this feature (or doesn't turn it off, when that feature is the default play configuration), the gaming machine may be configured to place the maximum wager for the player and initiated games automatically, without the player having to place wagers and initiate games (such as by hitting the "spin" button). This feature may be used by a player to ensure maximum play speed of games during a timed gaming event.

The games of the invention may be presented at a variety of gaming machines or systems other than that described in conjunction with FIGS. 1 and 6. For example, the games could be presented in a mobile gaming environment, such as on cellular phones. For example, a player might utilize their cellular phone to communicate with a game server. In another embodiment, the games of the invention may be implemented in an on-line format, such as from home or work computers. Once again, the player may connect to a server gaming device, such as over the Internet. Game play may then proceed as described. In these latter embodiments, it will be appreciated that software or game code may be required to be installed or loaded onto the device to enable play of the game. Such software may be downloaded to those devices or be permanently loaded into a memory thereof when they are manufactured or the like.

In one embodiment, the games of the invention may be played as "skill" games. For example, a player may or may not be required to place a wager. The player may then play for points. A player obtaining certain numbers of points (or a participant who does so via the participant portion of the game) may be entitled to prizes, such as gift certificates and goods. Such a variation of the game has particular applicability to on-line and wireless environment presentations.

As also indicated, the gaming machine or other device via which the game is presented may vary. As indicated, the machine may have a traditional "gaming machine" style or configuration. The various methods, including the games, may be presented in other environments, such as in a distributed environment. For example, the games may be implemented as "Internet" games. In one embodiment, a player may contact a game host, such as via computer via a communication link such as the Internet.

In one embodiment, various aspects of the invention may be implemented as an additional system or device to an existing gaming machine. For example, a gaming machine may be configured to present a main or base game. A communication device may be associated with the gaming machine, but not be directly integrated therewith. For example, a communication device may include a display, handset or the like which is physically associated with (connected or mounted thereto, or located proximate the machine), that device forming a part of a "bonus system," such as by being connected to a bonus server which communicates with the gaming machine. In this configuration, a bonus "system" is essentially associated with a generally separate gaming system including gaming machines.

It will be appreciated that the odds of obtaining winning combinations of the main or base game, the odds of triggering a bonus event, the odds or winning a bonus event, and the payouts, may vary. In one embodiment, the wager or bet which is placed is used to fund payouts for all portions of the game. Thus, the total payout for the base game may be relatively low, in order to fund large jackpots for the bonus/secondary events.

In one embodiment, participation in the bonus events, or at least the opportunity to win jackpots, may be tied to the player's placing a large or maximum bet. In one embodiment, the largest jackpots or awards may be configured as progressive awards. In such an arrangement, the size of the jackpot grows (based on bets placed at one or more machines) between periods when it is won. The jackpot may have a minimum funding amount, or may drop to zero when won.

It will be appreciated that the methods of the invention are exemplary and the various steps may be changed, including their order. Further, various of the features of the various bonus events may apply to one another or be incorporated therein, or be incorporated in entirely different games. Various of the features of the invention have been described as "bonus events." The events are referred to as a "bonus event" primarily because they offer play and/or a win opportunity which differs from the base game or event itself. However, the bonus events may be considered in one or more embodiments as essentially being a part of the base event, but just comprising one of the potential variations of game play of the base game or event, rather than events separate there from, since in a preferred embodiment the bonus events are triggered by outcomes of the play of the bonus event.

One aspect of the invention is a timed gaming event. In a preferred embodiment described above, the timed gaming event comprises a bonus event having a defined duration, that bonus event comprising the play of one or more games without a wager. The invention may comprise other timed gaming events, however. The timed gaming events of the event may comprise "base," "bonus" or other types of games, and may comprise a portion of a game. For example, the timed gaming event may comprise an entire gaming event, may comprise only a portion or duration of a gaming event (whether comprising one or more individual games) including a portion of a bonus or secondary event of a main gaming event, or may comprise an event which is associated with a gaming event (such as a bonus event associated with a main game event).

When associated with another event, the timed gaming event may be triggered or initiated based on several criteria. For example, as indicated above, the timed gaming event may be initiated based upon a particular base game outcome. The timed gaming event may also be randomly assigned or initiated, as in a 'mystery' format, where players do not know when or to whom the timed gaming event may be awarded. The timed gaming event might also be initiated based upon a player's reaching a particular level of play, such as based upon wagers, number of games or the like.

As indicated, a bonus event (timed, tournament or otherwise) may be triggered or initiated in various manners. In one embodiment, as indicated above, it might be initiated by a particular base game outcome at a gaming machine.

In another embodiment, the bonus event may be initiated by the bonus event server. For example, the bonus event controller may randomly generate results, such as numbers or game outcomes. One or more of those randomly selected events may trigger the bonus event (as indicated, the probability of triggering such an event may also change dynamically).

The results of the bonus event server may be generated internally and not displayed to a player. In another embodiment, however, bonus event outcomes may be displayed to a player. For example, a gaming machine may display bonus event "triggers" to a players, such as in a small window of the main game display or via a separate display. In this manner, the player may be able to see whether the bonus event selections are winning/triggering events, or non-triggering events. As one example, the bonus event server may be configured to generate video reel event outcomes. These outcomes may be displayed in a bonus window at the gaming machine. A bonus event outcome may be displayed corresponding to each base game outcome at each gaming machine. If the bonus event outcome is not triggering, the player can see that fact. If it is triggering, the player sees that outcome and knows that bonus event is triggered.

In one embodiment, once a timed gaming event is declared, a player may be required to initiate the event. For example, a timed gaming event may be declared or announced, and the player may be required to place a wager, press a button or provide other input in order to initiate the event. If the player does not initiate the event, then the opportunity to participate in the timed gaming event may be lost. For example, a timed gaming event may be randomly declared at a machine and announced to the player with a flashing message. The player may be instructed to place an additional wager or press a "spin" button to start the event. If the player does not do so within a period of time, the timed gaming event opportunity may pass.

The types of games or events with which the timed gaming event may be associated or which the timed gaming event may comprise may vary and include slot-type games (including any number of mechanical and/or video-simulated reels with any number of paylines), poker, dice (such as craps), roulette and other games now known or later developed. For example, the timed gaming event may comprise slot games or hands of video poker.

Preferably, the timed gaming event of the invention comprises an event which occurs or is enabled for play during a particular time interval. This time interval has a start time and an end time. The duration of the timed gaming event may be fixed, or might vary, such as randomly or based upon various criteria. Preferably, the duration of the timed gaming event is independent of game play, including results of games played at the gaming machine(s). Preferably, for example, the event time is randomly or otherwise selected, and is not determined by particular game outcomes or player actions. In one embodiment, the period of time may not run until the player provides input in the case where a player input is required. For example, if timed gaming event is declared and a player is required to place a wager or press a spin or deal button to start the event, the time period may begin to run only once such action is taken by the player.

In another embodiment, the timed gaming event may define a duration of time during which other activities may be enabled or occur, including activities which require a player to place a wager in order to participate. For example, in one embodiment, the timed gaming event may comprise a duration of time during which a player or players must place wagers in order to play games, but the amount of the wager(s) is reduced. For example, normally a player must place a maximum coin bet in order to obtain the highest possible payback for winning results. During a timed gaming event, a player may be permitted to place a smaller wager, such as a minimum single coin bet, but still have the opportunity to win higher or highest payouts for games played. In another variation, during a timed gaming event a player is required to place a wager to play one or more games, but the payout for winning results is increased over the normal payout for winning results. For example, payouts for winning results of games played during a timed gaming event may be subject to a multiplier, such as 2×, 3×, or more of the normal payout. Alternatively, additional winnings such as associated with an "enhanced" pay table may be paid. These features may also apply where the player is not required to place a wager. For example, during a timed gaming event the player may not be required to place a wager and may be entitled to enhanced winnings, such as via a multiplier or enhanced paytable, as compared to normal game play.

In another embodiment, the timed gaming event may involve more than one gaming machine and/or more than one player. For example, a plurality of players may participate in a timed gaming event at the same time, whether playing different games or participating in a group game, such as a tournament. A plurality of gaming machines may be associated with a timed event in such instances.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of maintaining the odds P of bonus event presentation in a gaming system where a varying number of gaming machines linked to a bonus server may be in active play comprising:

determining a number M of gaming machines in play;

if said number M=M1=1, selecting a number of games N=N1 which on average are played before a bonus event triggering event occurs;

if said number M=M2=2 or more, then selecting a number of games N=N1 * M2 which on average are played before said bonus event triggering event occurs;

triggering said bonus event on average every N games based upon said number M of gaming machines in play, wherein said number N varies actively depending upon changes in said number M of gaming machines in play so that the odds P of a bonus event being presented are generally the same regardless of said number M of gaming machines in play; and presenting said bonus event at said M gaming machines in play.

2. The method in accordance with claim 1 further comprising determining that a gaming Machine is in play if a player uses a player loyalty card at a gaming machine.

3. The method in accordance with claim 1 further comprising determining that a gaming machine is in play if wagers are being placed at said gaming machine.

4. The method in accordance with claim 1 further comprising determining if a player of a gaming machine M in play is qualified to participate in said bonus event and only presenting said bonus event at said gaming machine if said player is qualified.

5. The method in accordance with claim 1 further comprising presenting wagering games at said gaming machines, said wagering games comprising said N games.

6. The method in accordance with claim 5 wherein said step of triggering said bonus event comprises selecting a bonus event triggering symbol and causing said bonus event triggering symbol to appear in one of said N games.

7. The method in accordance with claim 5 wherein said step of triggering said bonus event comprises selected a bonus event game outcome and causing said bonus event game outcome to be awarded as an outcome of one of said N games.

8. The method in accordance with claim 1 wherein said bonus event comprises a tournament game involving said M gaming machines in play.

9. A wagering bonus game system comprising:

a plurality of gaming machines, each gaming machine having a game controller configured to present one or more base games; and a bonus server in communication with said plurality of gaming machines, the bonus server having a bonus event controller, said bonus event controller configured to trigger a bonus event by maintaining the odds P of bonus event presentation; wherein for a number of said gaming machines M in play where M=M1=1, said bonus event controller triggers said bonus event on average every N=N1 games played and wherein for a number of gaming machines M in play where M=M2=2 or more, said bonus event controller triggers said bonus event on average every N=N1 * M2 games played, wherein said number N varies actively depending upon changes in said number M of gaming machines in play so that the odds P of a bonus event being presented are generally the same regardless of said number M of gaming machines in play.

10. The game bonusing system in accordance with claim 9 wherein said bonus event comprises a tournament game involving the M gaming machines in play.

11. The game bonusing system in accordance with claim 9 wherein said bonus event comprises a timed event having a start and ending after a predetermined period of time.

12. The game bonusing system in accordance with claim 9 wherein said N games comprise wagering games presented at said M gaming machines.

13. The game bonusing system in accordance with claim 9 including a communication link between each gaming machine and said bonus event server.

14. The game bonusing system in accordance with claim 13 wherein said bonus server monitors said gaming machines via said communication links to determine which of said plurality of gaming machines is in play.

15. The game bonusing system in accordance with claim 9 wherein said bonus event controller is configured to trigger said bonus event by selecting a bonus event triggering symbol and causing said bonus event triggering symbol to appear in one of said N games at one of said M gaming machines in play.

* * * * *